US005839491A

United States Patent [19]

Kröner et al.

[11] Patent Number: 5,839,491

[45] Date of Patent: Nov. 24, 1998

[54] AWNING, FOR EXAMPLE JOINT-ARM AWNING WITH RAIN-PROOF BLIND

[75] Inventors: Sven Kröner, Mettingen; Bernhard Wessels, Rheine, both of Germany

[73] Assignee: Schmitz-Werke GmbH + Co., Emsdetten, Germany

[21] Appl. No.: 893,618

[22] Filed: Jul. 11, 1997

[30] Foreign Application Priority Data

Jul. 25, 1996 [DE] Germany ..... 296 12 905 U

[51] Int. Cl.[6] ..... E04F 10/00

[52] U.S. Cl. ..... 160/22; 160/66

[58] Field of Search ..... 160/66, 22, 67, 160/68, 69, 70, 78, 79; 135/88.11, 88.12

[56] References Cited

U.S. PATENT DOCUMENTS

| | | | |
|---|---|---|---|
| 4,469,159 | 9/1984 | Lohausen | 160/22 |
| 4,479,526 | 10/1984 | Rinaldi et al. | 160/22 |
| 4,566,516 | 1/1986 | Lohausen | 160/22 |
| 4,590,642 | 5/1986 | Hesener | 160/22 X |
| 4,673,017 | 6/1987 | Lauzier | 160/66 X |
| 5,121,782 | 6/1992 | Renkhoff et al. | 160/22 |
| 5,427,168 | 6/1995 | Lohausen | 160/66 |
| 5,492,162 | 2/1996 | Lohausen | 160/66 X |

FOREIGN PATENT DOCUMENTS

| | | |
|---|---|---|
| 8811102 | 2/1988 | Germany . |
| 9000939 | 12/1990 | Germany . |
| 9205339 | 2/1992 | Germany . |

*Primary Examiner*—David M. Purol
*Attorney, Agent, or Firm*—Browdy and Neimark

[57] ABSTRACT

In an awning, for example a joint-arm awning, comprising joint arms disposed on a support pipe, the inclination of the support pipe and thus the inclination of the joint arms and/or the inclination of the joint arms relative to the support pipe being adjustable, and an awning cloth extending between a drop-out pipe and a cloth roll disposed on a cloth shaft, and the portion of the cloth roll and the drop-out pipe, in the latter's retracted condition, being covered by a rain-proof blind, it is provided, with a view to ensuring an esthetically attractive, close-lying cover protecting from rain between the rain-proof blind and the drop-out pipe, even when the angle of inclination of the joint-arms is regulated in particular by rotation of the support pipe, that the rain-proof blind is mounted pivotally and is biased by at least one spring or by gravity in a direction toward the upper side of the awning cloth in such a way that the rain-proof blind rests on the upper side of the awning cloth regardless of the adjusted join-arm inclination.

5 Claims, 4 Drawing Sheets

AWNING, FOR EXAMPLE JOINT-ARM AWNING WITH RAIN-PROOF BLIND

BACKGROUND OF THE INVENTION

1. Field of the Invention

The invention relates to an awning, for example a joint-arm awning, comprising joint arms disposed on a support pipe, the inclination of the support pipe and thus the inclination of the joint arms and/or the inclination of the joint arms relative to the support pipe being adjustable, and an awning cloth extending between a drop-out pipe and a cloth roll disposed on a cloth shaft, and the portion of the cloth roll and the drop-out pipe, in the latter's retracted condition, being covered by a rain-proof blind.

2. Background Art

In joint-arm awnings of the generic type, the rain-proof blind provides for the entire awning arrangement to be protected from rain in the retracted condition, the front edge of the rain-proof blind fitting over the upper edge of the drop-out pipe or section, respectively.

SUMMARY OF THE INVENTION

It is the object of the invention to ensure an esthetically attractive, close-lying cover protecting from rain between the rain-proof blind and the drop-out pipe even when the angle of inclination of the joint-arms is regulated in particular by rotation of the support pipe.

According to the invention, this object is attained by the rain-proof blind being mounted pivotally and biased by a spring or gravity in a direction toward the upper side of the awning cloth in such a way that the rain-proof blind rests on the upper side of the awning cloth regardless of the adjusted joint-arm inclination.

The design according to the invention helps attain that without manual resetting, close-lying contact of the rain-proof blind is ensured for any change of the angle of inclination, which reliably prevents rain from penetrating and ensures an attractive overall appearance.

Even though a joint-arm awning is dealt with in the following, the basic idea according to the invention can be put into practice in the same way also with other types of awnings, for instance house awnings.

Preferably it is provided that the spring is a helical compression spring which extends between a front wall non-rotatably joined to the rain-proof blind and a non-rotatable appendix in a spring casing. As a result, the spring cannot be seen externally, and optimum resetting is ensured.

The appendix can be disposed non-rotatably relative to a support for the cloth shaft, the support itself being joined to the support pipe. In this way an abutment is formed for the compression spring to bear against.

Finally, provision can be made for the rain-proof blind to be connected with lateral exterior caps which, together with the rain-proof blind, are pivotally mounted so that a closed appearance in ensured also from the side regardless of the adjusted angle of inclination.

Details of the invention will become apparent from the ensuing description of an exemplary embodiment, taken in conjunction with the drawing.

DESCRIPTION OF THE PREFERRED EMBODIMENT

Figure 2:
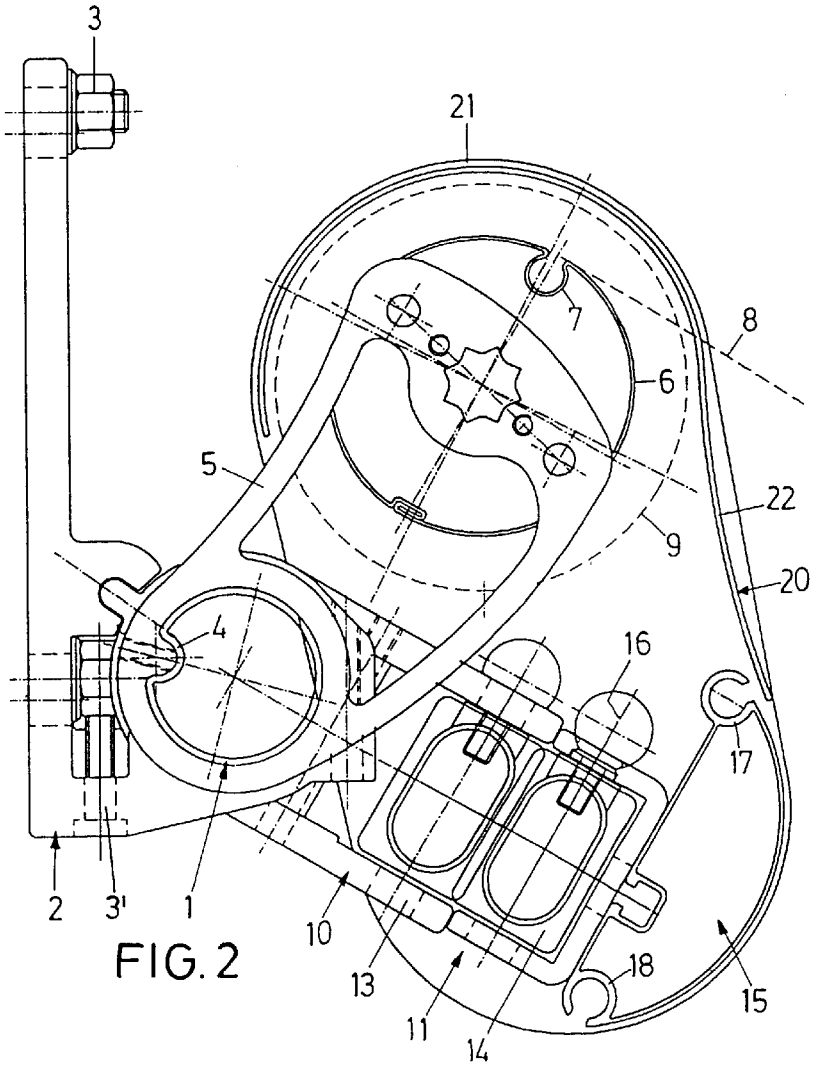
FIG. 2 is an illustration corresponding to FIG. 1 with the joint-arms inclined downward comparatively strongly.
Figure 1:
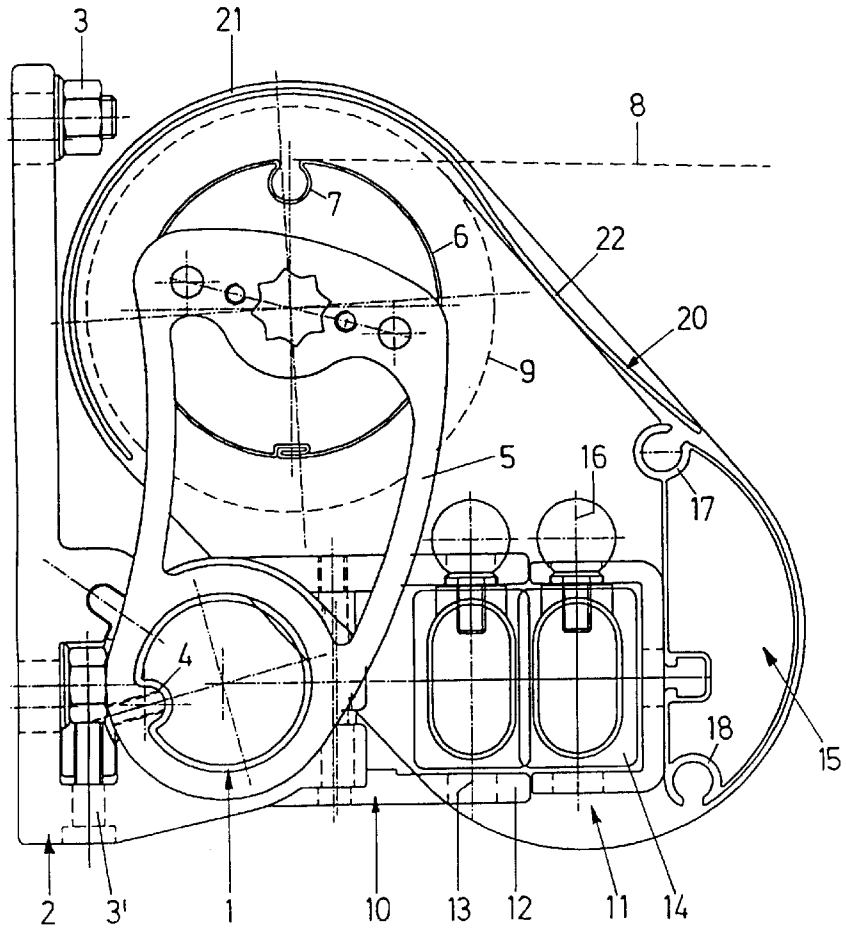
FIG. 1 is a lateral view of a joint-arm awning according to the invention in the retracted condition with the joint-arms substantially horizontal.

A joint-arm awning seen in the drawing comprises a support pipe 1 which is fixed to a wall (not shown) by means of at least two support-pipe holders 2 and fastening screws 3.

A setscrew 3' is disposed in the support-pipe holder 2, engaging with a groove 4 of the support pipe 1 by means of set cams (not shown) so that, by way of height adjustment of the set cam of the setscrew 3', the support pipe 1 can be rotated and adjustment of the angle of inclination can be accomplished.

A cloth shaft 6 is rotatably mounted by means of supports 5, the cloth shaft 6 having a piping groove 7 for the awning cloth 8, roughly outlined by dashes, to be fixed, which, in the retracted state, forms a roll of cloth 9 likewise roughly outlined by dashes.

Furthermore, joint arms 11 are arranged on the support pipe 1 by way of U-shaped supports 10, the joint arms 11 comprising an inner joint-arm section 12, which is mounted on the support 10 pivotally about a pivot axis 13, and an outer joint-arm section 14, which is joined to the first joint-arm section 12 by a pivot joint, and to the outer end of which a drop-out pipe 15 is articulated by way of a pivot axis 16. The drop-out pipe 15 has a first piping groove 17 for the outer end of the awning cloth 8 to be fixed and a second piping groove 18 for a fringe (not shown in the drawing).

An internal, bent section 21 of a rain-proof blind 20 extends semi-circularly in a section around the cloth shaft 6 and the cloth roll 9, respectively, and concentrically of the cloth shaft 6, and a substantially linear, outer section 22 of the rain-proof blind 20 runs in the direction toward the upper edge of the drop-out pipe as far as to the outer edge of the piping groove 17. The substantially linear section 22 is bent slightly downward, the bulging thus formed resting on the upper side of the awning cloth 8.

Figure 3:
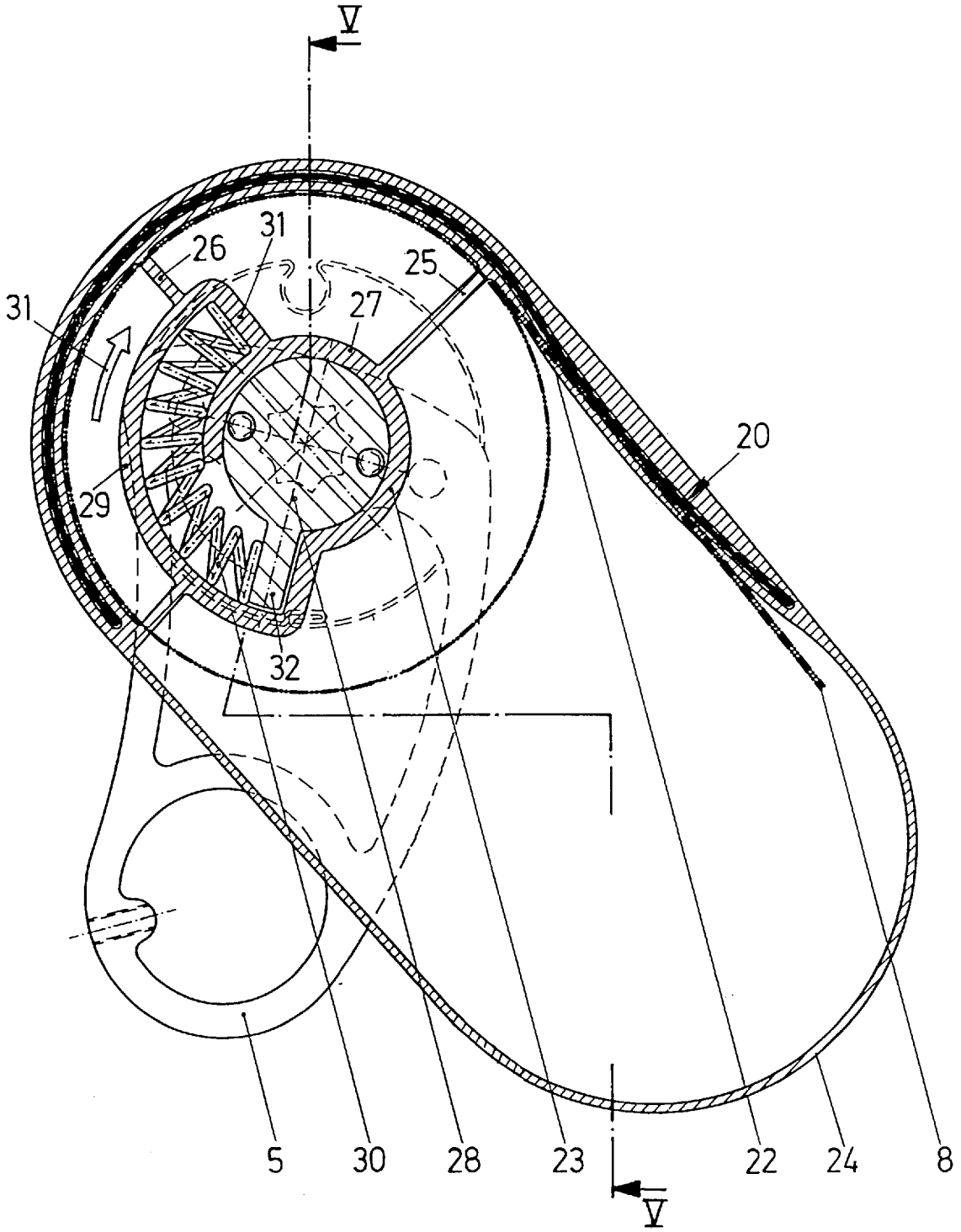
FIG. 3 is a vertical section V—V through the spring portion of a joint-arm awning according to the invention corresponding to the position seen in FIG. 1.
Figure 4:
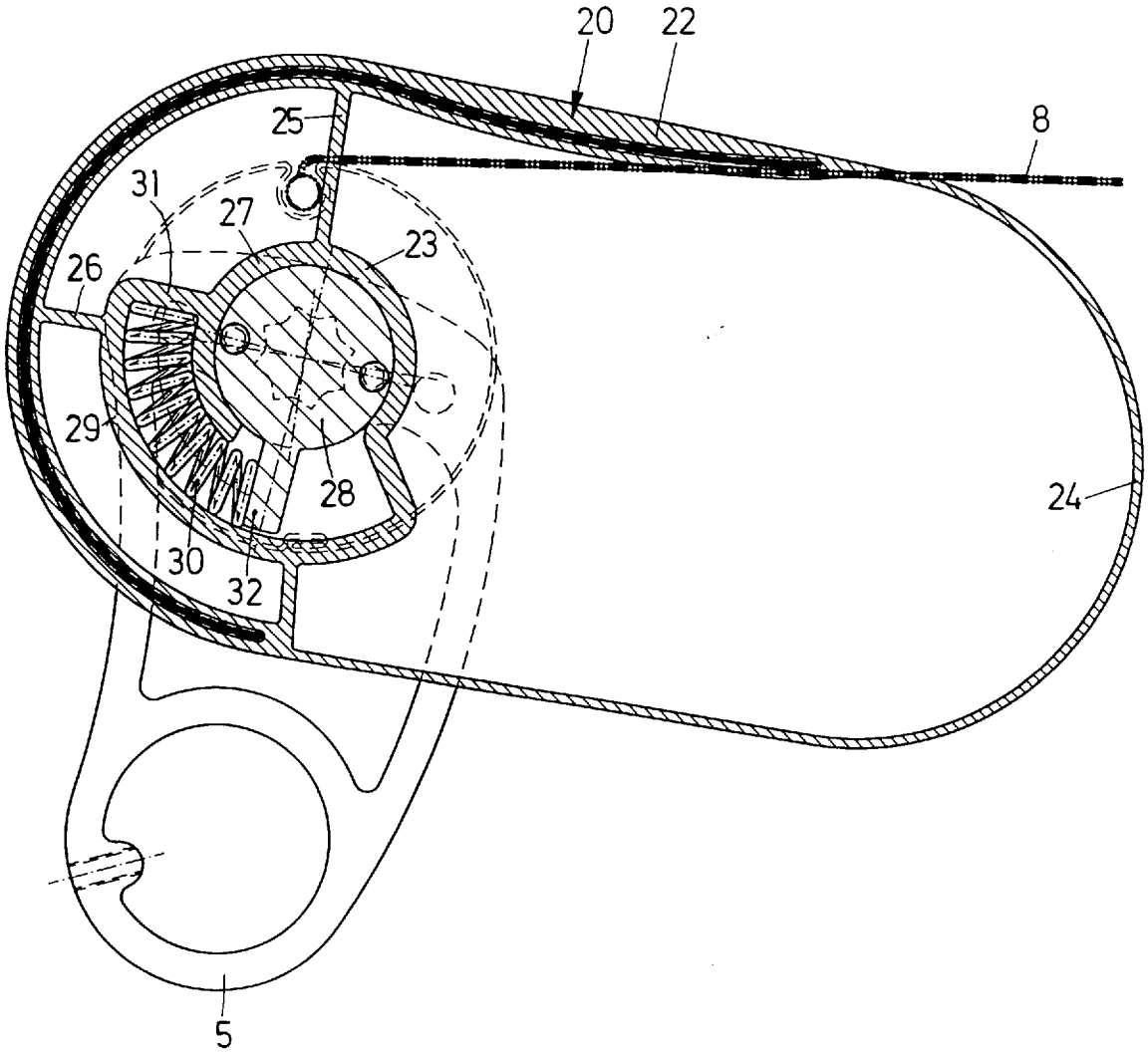
FIG. 4 is a section corresponding to FIG. 3 at a different angle.
Figure 5:
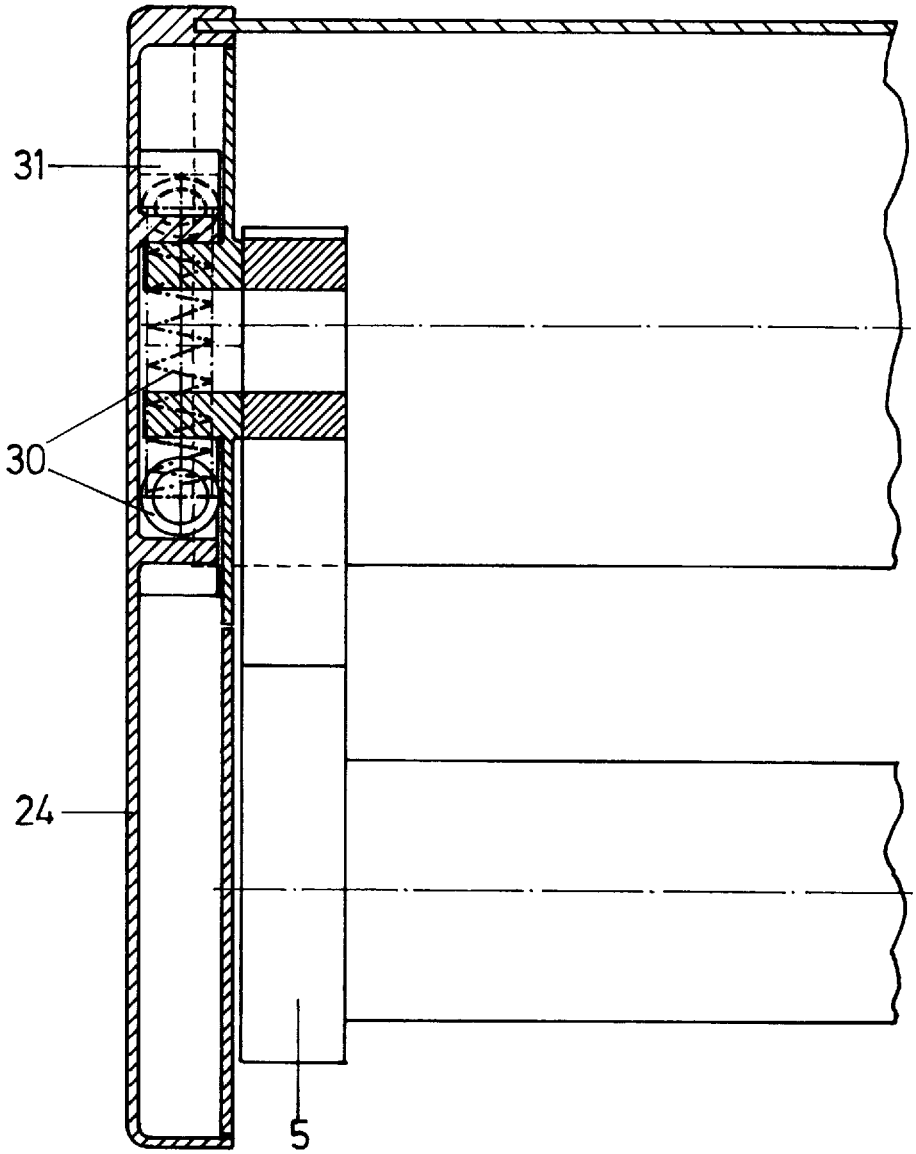
FIG. 5 is a section on the line V—V of FIG. 3.

As seen in FIG. 3, the cover 20 is connected with an exterior cap 23 comprising a lateral cover 24 which, seen from the side, in the retracted state overlaps the portion of the cloth roll 9, the drop-out pipe 15 and the retracted joint arms 11.

The exterior cap 23 comprises an inner section 27 connected with the cover 24 by means of webs 25, 26, the inner section 27 surrounding an interior cap 28 which is disposed coaxially to the cloth shaft 6 and non-rotatably relative to the support 5.

The section 27 further comprises a casing 29 for a helical spring 30 which is semi-circularly guided in the casing 29, supporting itself on a front wall 31 of the casing 29 on the one hand and on an appendix 32 on the interior cap 28 on the other so that this helical spring biases the section 27 and thus the exterior cap 22 and, by way of the latter, the rain-proof blind 20 in the direction of the arrow 31 so that the rain-proof blind 20 is along with gravity forced against the upper side of the awning cloth 8 regardless of the chosen adjustment of the angle of inclination, as can be seen in a comparison of FIG. 1 and FIG. 2 or FIG. 3 and FIG. 4, respectively.

What is claimed is:

1. An awning for a joint-arm awning, comprising joint arms (11) disposed on a support pipe (1), an inclination of the support pipe (1), the joint arms (11) and the joint arms (11) relative to the support pipe (11) being adjustable, and a rain-proof blind (20) covering an awning cloth (8) extending between a drop-out pipe (15) and a cloth roll (9) disposed on a cloth shaft (6), and a portion of the cloth roll (9) and the drop-out pipe (15), when the drop-out pipe (15) is retracted, wherein the rain-proof blind (20) is mounted pivotally and biased by at least one spring (30) and gravity in a direction toward an upper side of the awning cloth (8) so that the rain-proof blind (20) rests on the upper side of the awning cloth (8) at any inclination of the adjusted joint-arm.

2. A joint-arm awning according to claim 1, wherein the spring is a helical compression spring (30) which extends in a spring casing (29) between a front wall (31) non-rotatably joined to the rain-proof blind (20) and a non-rotatable appendix (32).

3. A joint-arm awning according to claim 2, wherein the appendix (32) is mounted non-rotatably relative to a support (5) for the cloth shaft (6), the cloth shaft (6) being connected with the support pipe (2).

4. A joint-arm awning according to claim 1, wherein the rain-proof blind (20) is connected with lateral exterior caps (23) which are mounted pivotally with the rain-proof blind (20).

5. A joint-arm awning according to claim 3, wherein the helical compression spring (30) is disposed between the rain-proof blind (20) and the support (5).

* * * * *